US007156093B2

(12) United States Patent
King

(10) Patent No.: US 7,156,093 B2
(45) Date of Patent: Jan. 2, 2007

(54) INFLATABLE RESPIRATOR HOOD

(75) Inventor: John H. King, Cynthiana, KY (US)

(73) Assignee: E. D. Bullard Company, Cynthiana, KY (US)

( * ) Notice: Subject to any disclaimer, the term of this patent is extended or adjusted under 35 U.S.C. 154(b) by 182 days.

(21) Appl. No.: 10/761,569

(22) Filed: Jan. 21, 2004

(65) Prior Publication Data

US 2005/0061317 A1 Mar. 24, 2005

Related U.S. Application Data

(60) Provisional application No. 60/504,292, filed on Sep. 18, 2003.

(51) Int. Cl.
*A62B 17/04* (2006.01)
*A42B 1/04* (2006.01)

(52) U.S. Cl. ..... 128/201.22; 128/201.23; 2/205

(58) Field of Classification Search ..... 128/205.25, 128/201.22, 201.24, 201.25, 201.29, 201.23, 128/867, 200.28; 2/171.3, 413, 424, 205, 2/205.26, 200.28, 201.14, 201.23
See application file for complete search history.

(56) References Cited

U.S. PATENT DOCUMENTS

| | | | | |
|---|---|---|---|---|
| 1,917,961 | A * | 7/1933 | Fee | 128/200.27 |
| 2,296,338 | A | 9/1942 | Dakin | |
| 3,080,586 | A * | 3/1963 | Steinke | 128/201.23 |
| 3,438,060 | A * | 4/1969 | Gregory et al. | 2/6.3 |
| 4,057,058 | A | 11/1977 | Kovacevic | |
| 4,236,514 | A | 12/1980 | Moretti | |
| 4,411,264 | A * | 10/1983 | Jacobson | 128/201.23 |
| 4,484,575 | A * | 11/1984 | Brockway et al. | 128/201.23 |
| 4,552,140 | A | 11/1985 | Cowley et al. | |
| 4,552,150 | A * | 11/1985 | Zacouto | 607/25 |
| 4,619,254 | A | 10/1986 | Moretti et al. | |
| 4,676,236 | A * | 6/1987 | Piorkowski et al. | 128/201.23 |
| 5,035,239 | A * | 7/1991 | Edwards | 128/205.23 |
| 5,133,344 | A * | 7/1992 | Jurrius et al. | 128/201.23 |
| 5,283,914 | A * | 2/1994 | James | 2/424 |
| H1316 | H | 6/1994 | McGuinness | |

(Continued)

FOREIGN PATENT DOCUMENTS

| | | |
|---|---|---|
| DE | 2932348 | 2/1981 |

(Continued)

OTHER PUBLICATIONS

European Patent Office, European Search Report, Aug. 23, 2006, pp. 1-3.

*Primary Examiner*—Teena K. Mitchell
*Assistant Examiner*—Shumaya Ali
(74) *Attorney, Agent, or Firm*—Stites & Harbison, PLLC; David W. Nagle, Jr.

(57) ABSTRACT

A respirator hood is designed to fit over and around the head of a wearer and includes a substantially transparent lens received in a front opening of the hood. An inflatable neck cuff is positioned near a lower portion of the hood and substantially circumscribes an opening through which the wearer inserts his head, with the inflatable neck cuff being supplied by an air source and inflated so as to exert a sealing pressure against the neck of the wearer and to prevent the hood from rising up relative to the head of the wearer. The respirator hood also includes one or more overhead channels which define an air delivery path from the air source over the head of the wearer to the interior of the lens and downwardly across the face of the wearer.

10 Claims, 4 Drawing Sheets

U.S. PATENT DOCUMENTS

| | | | | |
|---|---|---|---|---|
| 5,402,535 | A * | 4/1995 | Green | 2/468 |
| 5,495,847 | A | 3/1996 | Hu | |
| 5,526,804 | A | 6/1996 | Ottestad | |
| 5,797,146 | A | 8/1998 | Matich | |
| 5,819,728 | A | 10/1998 | Ritchie | |
| 6,012,175 | A | 1/2000 | Johnston | |
| 6,240,567 | B1 | 6/2001 | Johnston | |
| 6,279,572 | B1 * | 8/2001 | Danisch et al. | 128/201.25 |
| 6,296,204 | B1 * | 10/2001 | Lewis et al. | 244/122 AG |
| 6,370,695 | B1 | 4/2002 | Paris et al. | |
| 6,371,116 | B1 * | 4/2002 | Resnick | 128/206.24 |
| 6,622,311 | B1 | 9/2003 | Diaz et al. | |
| 6,792,623 | B1 * | 9/2004 | Luppi | 2/171.3 |
| 6,810,532 | B1 * | 11/2004 | Wang Lee | 2/171.3 |
| 6,895,959 | B1 * | 5/2005 | Lukas | 128/200.28 |
| 2003/0075174 | A1 | 4/2003 | Shahaf | |
| 2003/0111074 | A1 | 6/2003 | Alon et al. | |
| 2003/0111075 | A1 | 6/2003 | Wen | |
| 2003/0131846 | A1 | 7/2003 | Campbell et al. | |

FOREIGN PATENT DOCUMENTS

| | | |
|---|---|---|
| DE | 3707952 | 9/1988 |
| EP | 0 363 530 | 4/1990 |
| FR | 2491339 | 4/1982 |
| FR | 2614538 | 11/1988 |

* cited by examiner

INFLATABLE RESPIRATOR HOOD

CROSS-REFERENCE TO RELATED APPLICATIONS

The present application claims priority to U.S. Provisional Application Ser. No. 60/504,292 filed Sep. 18, 2003, the entire disclosure of which is incorporated herein by reference

BACKGROUND OF THE INVENTION

The present invention relates to a respirator hood, and, more particularly, to a respirator hood that fits comfortably over the head of a wearer and provides for efficient delivery of air to the interior of the hood and into the breathing zone of the wearer.

In various industries and manufacturing environments, a respirator hood is worn in combination with a positive pressure air source to protect against respiratory hazards, such as those found in pharmaceutical operations and health-care facilities. Regardless of the specific application for which the respirator hood is designed, it commonly includes an integral bib or shroud or a neck cuff of some kind, an internal suspension means, a face shield or some form of transparent lens in a front opening defined by the hood, and a port for connection to a positive pressure air source.

However, because air is simply forced into the hood in most constructions, there is no efficient delivery of air to the interior of the lens and into the breathing zone of the wearer. Furthermore, since respirator hoods are commonly constructed of a flexible material, such as that marketed and distributed by E.I. duPont de Nemours and Company of Wilmington, Del. under the trademark Tychem®, the introduction of air into the interior of the hood has an inflating or ballooning effect that causes the hood to rise up relative to the head of the wearer.

It is therefore an object of the present invention to provide a respirator hood that ensures for efficient delivery of air to the interior of the hood and into the breathing zone of the wearer.

It is another object of the present invention to provide a respirator hood that prevents the ballooning and "rising up" of the respirator hood relative to the wearer, but without the need for cumbersome and uncomfortable suspension systems common in the prior art.

These and other objects and advantages of the present invention will become apparent upon a review of the following description and appended claims.

SUMMARY OF THE INVENTION

The present invention is a respirator hood that fits comfortably over the head of a wearer and provides for efficient delivery of air to the interior of the hood and into the breathing zone of the wearer. A hood made in accordance with the present invention is designed to fit over and around the head of a wearer and defines a front opening in which a transparent lens is received to protect the face of the wearer without obstructing vision. Air is provided through an inlet and is directed into a reservoir within the hood. From this reservoir, air is distributed to an inflatable neck cuff and one or more overhead channels that provide for efficient delivery of air to the interior of the hood and into the breathing zone of the wearer.

The neck cuff is positioned at the lower portion of the hood and substantially circumscribes the opening through which a wearer inserts his head into the hood. Incoming air inflates the neck cuff. Since there is no exit or outlet from the neck cuff, it remains inflated, thus causing the neck cuff to exert maximum sealing pressure against the wearer's neck and also prevents the hood from rising up relative to the wearer's head due to the upward forces resulting from the introduction of air into the interior of the hood.

Air is also directed from the reservoir into one or more overhead channels that provide for efficient delivery of air to the interior of the hood and into the breathing zone of the wearer. In one exemplary embodiment, and as further described herein, the hood is provided with three channels, although fewer or more channels could be incorporated into the hood without departing from the spirit and scope of the present invention. By providing multiple overhead channels, as opposed to a single, unitary channel, movement of the hood due to the air flow from the rear of the hood to the front of the hood is minimized. Specifically, by providing multiple overhead channels, there is not a significant extension of the channels into the interior of the hood, increasing headroom and reducing the likelihood that movement of the hood would cause the lens to be pushed against the wearer's face.

Lastly, it is contemplated that a hood made in accordance with the present invention could be provided with an integral exhalation valve that is designed to open and place the interior of the hood in fluid communication with the atmosphere should the air pressure within the hood exceed a predetermined value.

DETAILED DESCRIPTION OF THE INVENTION

The present invention relates to a respirator hood, and, more particularly, to a respirator hood that fits comfortably over the head of a wearer and provides for efficient delivery of air to the interior of the hood and into the breathing zone of the wearer.

Figure 1:
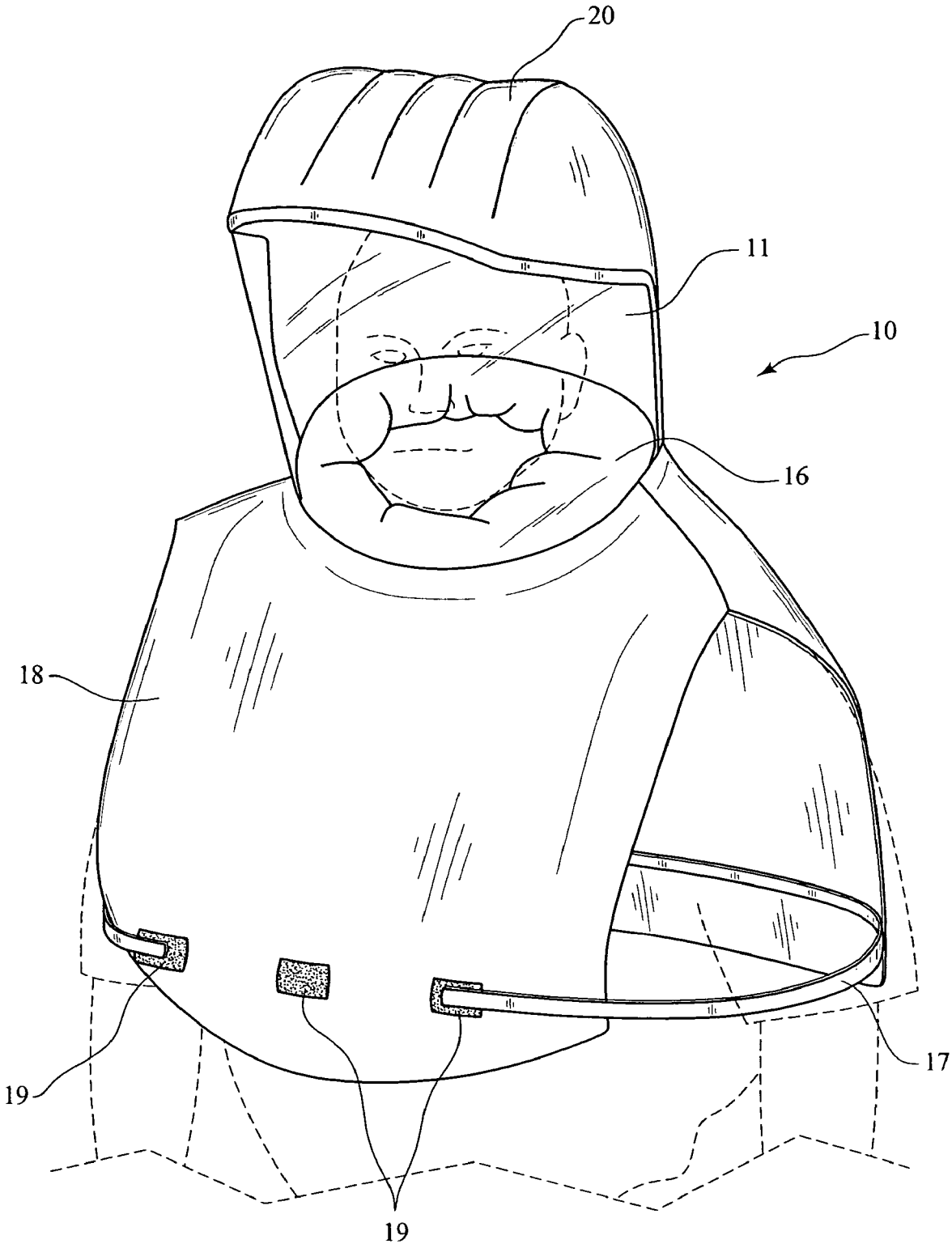
FIG. 1 is a front perspective view of an exemplary embodiment of a respirator hood made in accordance with the present invention as worn by an individual.
Figure 2:
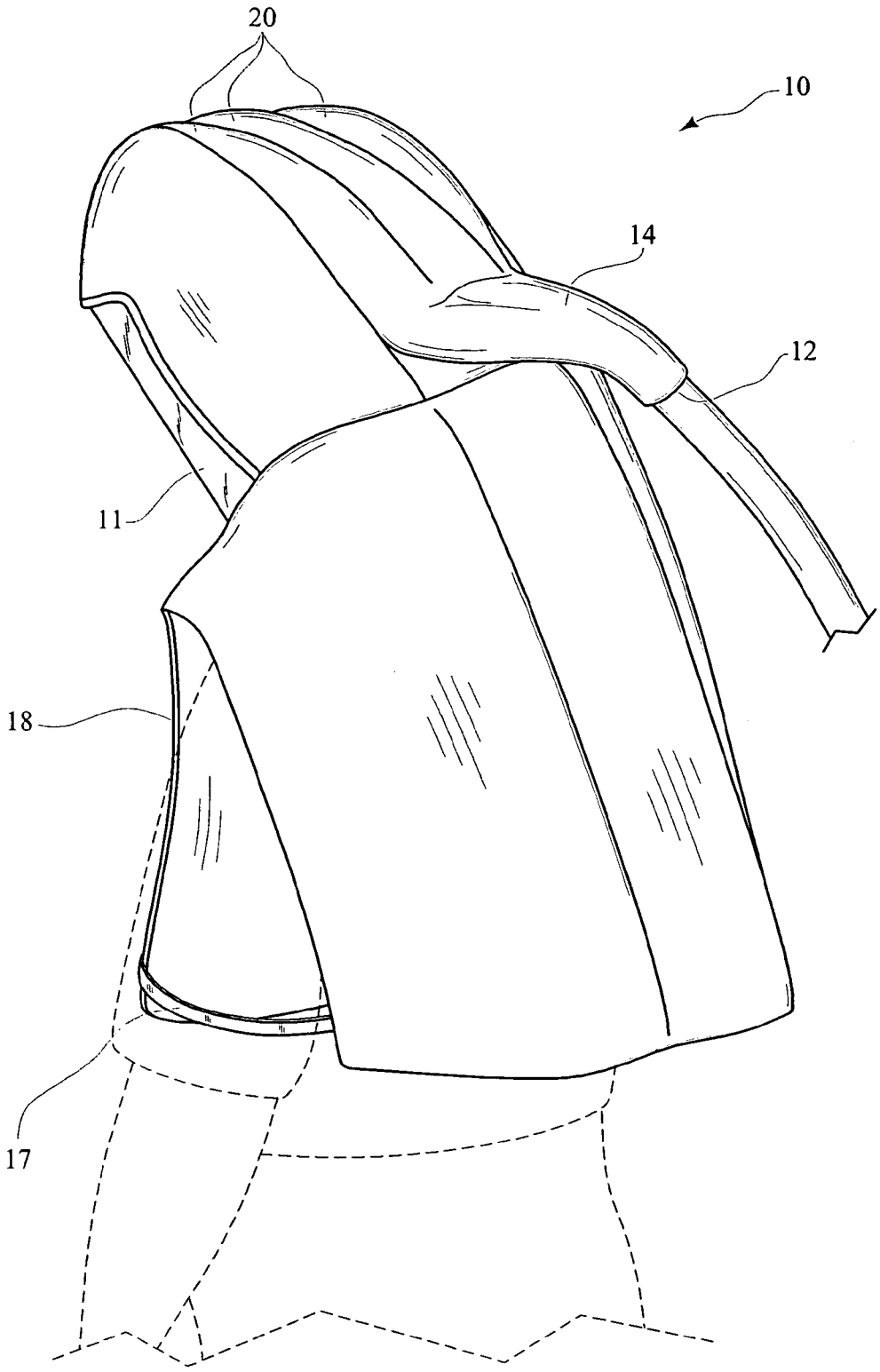
FIG. 2 is a rear perspective view of the respirator hood of FIG. 1 as worn by an individual.
Figure 3:
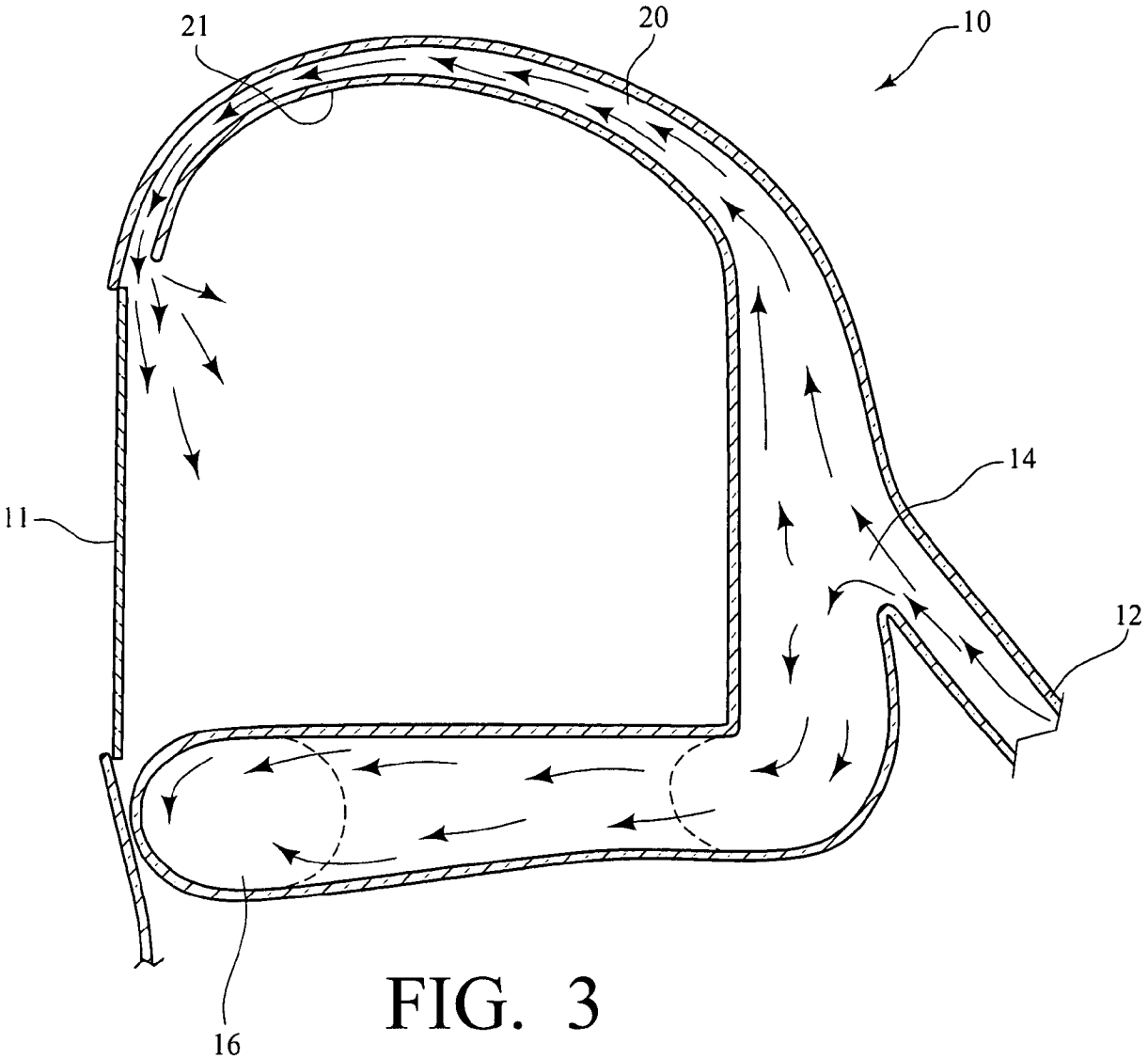
FIG. 3 is a sectional view of the respirator hood of FIG. 1 as worn by an individual.

FIGS. 1 and 2 are respective front and rear perspective views of an exemplary embodiment of a respirator hood 10 as worn by an individual, and FIG. 3 is a sectional view of this exemplary embodiment. The hood 10 is designed to fit over and around the head of a wearer. Since this particular hood 10 is designed to provide respiratory protection, it is preferred that it be constructed of a lightweight, chemical-resistant material, such as that marketed and distributed by E.I. duPont de Nemours and Company of Wilmington Del. under the trademark Tychem®. The hood 10 also defines a front opening in which a transparent lens 11 is received. The lens 11 protects the face of the wearer without obstructing vision, and thus, it is preferred that the lens 11 be splash and/or solvent resistant.

Referring now to FIG. 2, air is provided (preferably by an external positive pressure air source) through an inlet 12 and is directed into a reservoir 14. From this reservoir, and as best illustrated in FIG. 3, air is distributed to (a) an inflatable neck cuff 16, and (b) one or more overhead channels 20 that provide for efficient delivery of air to the interior of the hood 10 and into the breathing zone of the wearer.

Referring now to FIG. 1, the neck cuff 16 is positioned at the lower portion of the hood 10 and substantially circumscribes the opening through which a wearer inserts his head into the hood 10. Once the hood 10 is so positioned on the wearer's head, incoming air inflates the neck cuff 16. However, unlike prior art constructions, there is no exit or outlet from the neck cuff 16. Rather, the neck cuff 16 remains inflated, thus causing the neck cuff 16 to exert maximum sealing pressure against the wearer's neck. In this regard, the front portion of the neck cuff 16 fits under the wearer's chin. This position not only ensures proper sealing against the wearer's neck, but also prevents the hood 10 from rising up relative to the wearer's head due to the upward forces resulting form the introduction of air into the interior of the hood 10.

Furthermore, as illustrated in FIGS. 1 and 2, the hood 10 may also include a retaining bib or skirt 18 that extends downwardly from the front portion of the hood 10 and serves to retain and restrain the neck cuff 16 from being forced outwardly, away from the wearer's chin. In this regard, the bib 18 illustrated in FIGS. 1 and 2 includes one or more straps 17 that are designed to fit under the wearer's arms, retaining the bib 18 against the body of the wearer. In this regard, the ends of the straps 17 are provided with hook and loop portions (not shown) adapted to mate with corresponding hook and loop portions 19 on the bib 18 to secure the straps 17 around the body of the wearer. Furthermore, if desired, such a retaining bib 18 could be integral to and formed as part of a larger bib which is used in conjunction with a protective body covering.

As mentioned above, air is also directed from the reservoir 14 into one or more overhead channels 20 that provide for efficient delivery of air to the interior of the hood 10 and into the breathing zone of the wearer. In the exemplary embodiment illustrated in FIGS. 1–3, the hood 10 is provided with three channels 20, although fewer or more channels could be incorporated into the hood 10 without departing from the spirit and scope of the present invention. To construct such channels 20, it is preferred that the hood 10 include a section of non-rigid material 21 (preferably the same material that is used to construct the remainder of the hood 10) that is sewn or otherwise secured into the interior of the hood 20. Thus, as best illustrated in the perspective views of FIGS. 1 and 2, by securing this section of non-rigid material 21 (shown in FIG. 3) to the interior of the hood 10 in a predetermined pattern, the desired air delivery channels 20 are formed. These channels 20 define an air delivery path from the reservoir 14, over the wearer's head to the interior of the lens 11 and downwardly across the wearer's face into the wearer's breathing zone. Not only does this ensure the efficient delivery of air to the breathing zone, the directed air flow also reduces lens fog, which is created within the hood 10 due to the wearer's breathing, body heat, and perspiration.

As mentioned above, the hood 10 is preferably provided with three channels 20. By providing multiple overhead channels 20, as opposed to a single, unitary channel, movement of the hood 10 due to the air flow from the rear of the hood 10 to the front of the hood is minimized. Specifically, if there were only a single channel, there would be a significant distance between the interior surface of the hood 10 and the section of non-rigid material 21 when inflated. In other words, the cross-sectional area of the channel would be quite large and would extend quite far into the interior of the hood 10, reducing the available headroom within the interior of the hood 10. By providing multiple overhead channels 20, there is not such a significant extension of the channels into the interior of the hood 10, increasing headroom and reducing the likelihood that movement of the hood 10 would cause the lens 11 to be pushed against the wearer's face.

Figure 4A:
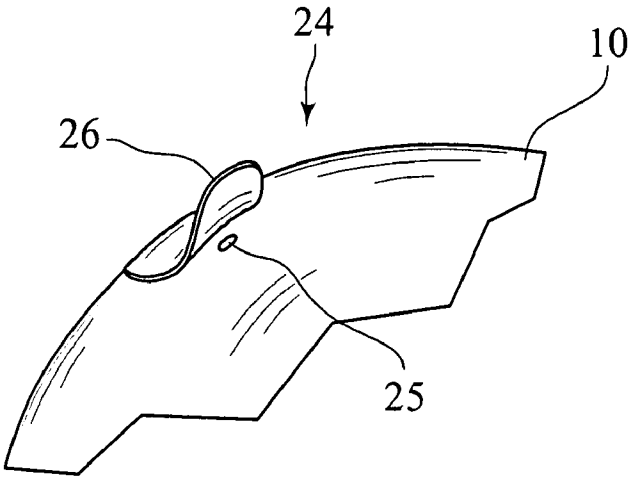
FIG. 4*a* is an enlarged perspective view of the exhalation valve illustrated in FIG. 4.
Figure 4:
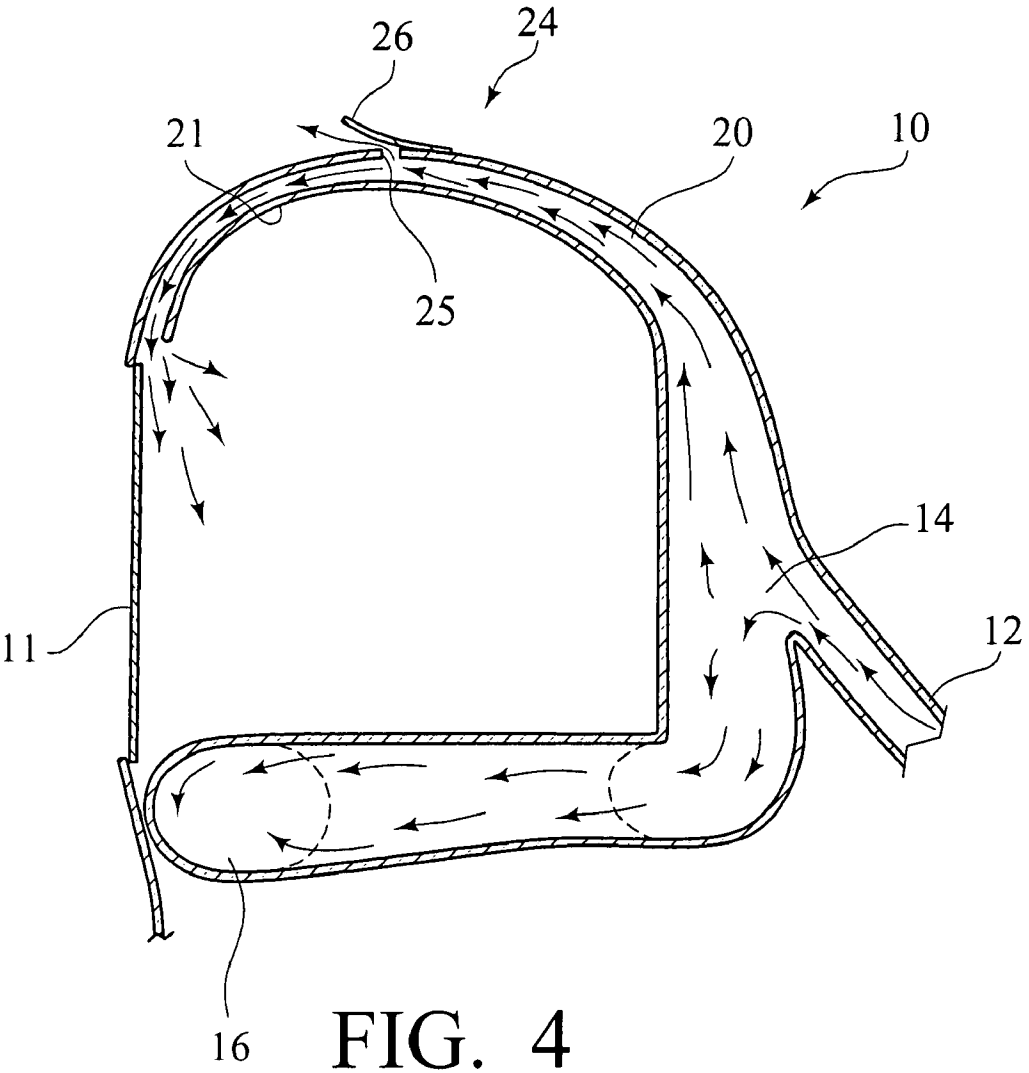
FIG. 4 is a sectional view of an alternate exemplary embodiment of a respirator hood made in accordance with the present invention, in which the respirator hood is provided with an exhalation valve.

Lastly, it should be noted that since there is no exit or outlet from the inflatable neck cuff 14, air is vented from the interior of the hood 10 between the inflatable cuff 14 and the neck of the wearer. Alternatively, as illustrated in FIGS. 4 and 4*a*, the hood 10 may be provided with an integral exhalation valve 24. In this particular embodiment, the exhalation valve 24 is comprised of (a) an opening or aperture 25 through an exterior surface of the hood 10 such that there is fluid communication from the atmosphere into one of the air delivery channels 20, and (b) a covering 26 that extends over the opening or aperture 24. The covering is preferably bonded to the hood 10 using an adhesive or similar means, but is designed to overcome the bond and pull away from the hood 10, thus opening the valve 24 should the air pressure within the hood 10 exceed a predetermined value.

Furthermore, it should be understood that the exhalation valve 24 could be positioned in various other locations without departing from the spirit and scope of the present invention, provided that the exhalation valve 24 serves to relieve pressure from the interior of the hood 10 when air pressure within the hood 10 exceeds a predetermined value. For example, the exhalation valve 24 could be located in a side portion of the hood 10, in a lower portion of the hood 10 near the neck cuff 16, or adjacent the lens 11. Furthermore, multiple exhalation valves 24 could be incorporated into the hood 10 without departing from the spirit and scope of the present invention.

It will be obvious to those skilled in the art that further modifications can be made to the embodiments described herein without departing from the spirit and scope of the present invention.

The invention claimed is:

1. In a flexible respirator hood designed to fit over and around the head of a wearer, and including a substantially transparent lens received in a front opening of the hood, the improvement comprising:

an inflatable neck cuff positioned near a lower portion of the hood and substantially circumscribing an opening through which the wearer inserts his head, said inflatable neck cuff being supplied by an air source, and said inflatable neck cuff having no outlet into the interior of the hood such that, once inflated, it fits under the chin of the wearer and exerts a sealing pressure against the neck of the wearer, thus preventing the hood from rising up relative to the head of the wearer due to upward forces resulting from introduction of air into the hood; and multiple overhead channels which define an air delivery path from the air source over the head of the wearer to the interior of the lens and downwardly across the face of the wearer.

2. The respirator hood as recited in claim 1, and further comprising an air reservoir, said air reservoir receiving air from the air source and then distributing air to the inflatable neck cuff and said one or more overhead channels.

3. The respirator hood as recited in claim 1, wherein there are at least three overhead channels.

4. The respirator hood as recited in claim 2, wherein there are at least three overhead channels.

5. The respirator hood as recited in claim 1, and further comprising an integral exhalation valve in an exterior surface of said hood, said valve opening when air pressure within the hood exceeds a predetermined value.

6. The respirator hood as recited in claim 5, wherein said exhalation valve includes an opening through the exterior surface of said hood and a covering that extends over the opening, said covering being bonded to the hood, but overcoming the bond and pulling away from the hood to open said exhalation valve should the air pressure within the hood exceed the predetermined value.

7. A respirator hood designed to fit over and around the head of a wearer, comprising:

a substantially transparent lens received in a front opening of the hood;

an inflatable neck cuff positioned near a lower portion of the hood and substantially circumscribing an opening through which the wearer inserts his head, said inflatable neck cuff fitting under the chin of the wearer and being supplied by an air source and inflated so as to exert a sealing pressure against the neck of the wearer, thus preventing the hood from rising up relative to the head of the wearer due to upward forces resulting from introduction of air into the hood;

one or more overhead channels which define an air delivery path from the air source over the head of the wearer to the interior of the lens and downwardly across the face of the wearer; and an air reservoir, said air reservoir receiving air from the air source and then distributing air to the inflatable neck cuff and said one or more overhead channels.

8. The respirator hood as recited in claim 7, wherein there are at least three overhead channels.

9. The respirator hood as recited in claim 7, and further comprising an integral exhalation valve in an exterior surface of said hood, said valve opening when air pressure within the hood exceeds a predetermined value.

10. The respirator hood as recited in claim 9, wherein said exhalation valve includes an opening through the exterior surface of said hood and a covering that extends over the opening, said covering being bonded to the hood, but overcoming the bond and pulling away from the hood to open said exhalation valve should the air pressure within the hood exceed the predetermined value.

* * * * *